United States Patent [19]

Connor

[11] 4,403,707

[45] Sep. 13, 1983

[54] COMBINATION CONTAINER CAP AND CLOSURE SEAL

[75] Inventor: John T. Connor, Norristown, Pa.

[73] Assignee: The West Company, Phoenixville, Pa.

[21] Appl. No.: 320,579

[22] Filed: Nov. 12, 1981

[51] Int. Cl.[3] ..... B65D 41/42

[52] U.S. Cl. ..... 215/253; 215/305

[58] Field of Search ..... 215/253, 305, 324, 347; 264/268

[56] References Cited

U.S. PATENT DOCUMENTS

| | | | |
|---|---|---|---|
| 1,237,761 | 8/1917 | Dwyer | 215/325 |
| 1,711,232 | 4/1929 | Kimmel | 215/324 |
| 2,180,055 | 11/1939 | Hunt | 215/303 |
| 3,465,906 | 9/1969 | Wagner et al. | 215/253 |
| 4,085,186 | 4/1978 | Rainer | 264/268 |

FOREIGN PATENT DOCUMENTS

| | | | |
|---|---|---|---|
| 1278939 | 6/1972 | United Kingdom | 215/347 |

*Primary Examiner*—Donald F. Norton

*Attorney, Agent, or Firm*—Eugene E. Renz, Jr.

[57] ABSTRACT

A combination TIP-OFF cap and container closure and sealing means adapted for operative assembly to a container to seal an access opening therein, thereby to seal the contents of the container. The cap comprises an elongated exterior top portion and an open ended skirt depending therefrom and formed integrally therewith. The skirt has a lower edge removably secured to the container adjacent the access opening. The combination TIP-OFF cap and closure sealing means is conjointly operatively connected to and removable from the container as an integrated unit to provide an access to the contents of the container by application of a lateral tilting force against the elongated cap exterior portion at a position remote from the connection of the cap to the container. The sealing means comprises a resilient material integrated with the cap interior and disposed within the interior of at least the skirt portion and extending into a portion of the elongated exterior top portion of the cap which is sealingly engaged with and about the access opening with the cap operatively mounted on the container.

10 Claims, 5 Drawing Figures

COMBINATION CONTAINER CAP AND CLOSURE SEAL

TECHNICAL FIELD

The invention relates generally to open ended containers and, more specifically, to those types of containers adapted for containing medicaments or "single use products" such as small liquor bottles, single dose medications for oral use, single dose powder products, and many other single use products. The invention is not restricted to such particular sizes, however, since the principles are applicable in other containers requiring caps and closure seals.

One specific, and significant, type of container adapted for desirable combination with the present cap is a container for serum material, and therefore the container is in the nature of known and used serum vials. In this particular field of use, among others, the combination TIP-OFF container cap and seal is of such construction, and has such a relationship to the container, that it allows the sealed vial to be opened in much the same manner as currently known and used similar container types of all-glass ampules, but with a substantial reduction of possibility of container, such as glass, breakage. The present cap design and structure allows for full removal of the cap and a resultant access opening or removal of a closure seal from a serum vial. Such removal normally takes place prior to the filling of a syringe from the vial.

Accordingly, the invention is primarily directed to containers, and closures, of small sizes as outlined above, but larger sizes of containers are contemplated within the invention, appropriate dimensions to be used.

The containers and their combination TIP-OFF container cap and closure seals are designed primarily to be non-reusable, inexpensive, security proficient and safe in operation of removal of the combination cap and seal from the body of the container, and in the absence of container breakage.

BACKGROUND OF THE INVENTION

Numerous types of containers, in combination with caps and sealing means for container openings, have heretofore been known and used. Some of these have provided for ease of removal of the closing and sealing cap means from the container.

The containers and their closure caps and seals can be constructed of different materials, and specific structures differ substantially as regards the intercoaction of the caps and sealing means with access openings for the containers.

Different types of containers, having different types of closures, and adapted to contain small quantities of materials are found in many different specific forms and configurations. The manner in which the containers are opened is of substantial significance, especially as regards containers adapted for use in the medical field for containment of medicines, serums and the like. In addition to ease of opening, the structures must substantially insure against breakage and/or contamination of the contents of the container.

Some such combination containers and closures have not fully met the requirements, or desires of users in various usage fields. Some of the prior constructions have been complicated and expensive in materials as well as construction or formation of the end product. Other constructions have introduced problems of breakage when opening for access to the contents thereof. Principally, although not necessarily restricted thereto, the present invention is directed to a closure cap and sealing means for containers which will permit integral removal of the cap and a closure seal from, for example, a serum vial, prior to filling of a syringe from the vial, or other types of containers requiring ease of, and safety of, removal of the caps from the containers.

The present invention has the capability of broad areas of use but, as outlined above, principally, the invention is directed to a new type of cap which, when sealed to a container in the nature of a serum vial, and incorporating an access opening seal therein, allows the so-closed and sealed vial to be opened easily, rapidly and with a substantial guarantee of the absence of breakage of the container material. Other obvious uses exist for concepts and teachings of the invention.

While the present invention will be specifically described in preferred constructional forms, the invention, obviously, is not limited as regards function, and/or the specifics of the construction. Variations in use, and specifics of constructional details and materials, will be obvious and within the scope of the invention.

It is to be noted from the following detailed description and disclosure of preferred embodiments of the invention, that specifically different forms and details are provided on the disclosed embodiments, and variations within the scope of the invention can be effected.

SUMMARY OF THE INVENTION

The present invention is broadly directed to a combination tip-off closure cap in combination with closure sealing means for operatively closing and sealing an access opening of a container. The compound, or combined closure includes therein, as a component part thereof, a sealing member or means, which is cooperatively engagable with the access opening in a fluid sealing relation therewith. In other words, the compound or combination TIP-OFF cap and container opening closure and sealing means, in the end product, constitutes a single unit or entity in application and use.

The cap consists of an upper, elongated tubular configuration having an open bottom end. Proximate, and above the open bottom end, there is a peripherally enlarged terminal hollow skirt portion, adapted for engagement over the container and over and around the access opening thereof. The skirt portion is frictionally and detachably mechanically engaged with, and surrounds, the container finish or exterior about the access opening. The skirt portion encloses and positionally maintains the composite closure means in closing and sealing engagement with the access opening. The operational joinder of the cap and container is enhanced by a crimping around and under the finish of the lower edge of the skirt terminal portion of the cap. During application and crimping, the sealing material is brought into sealing engagement with the access opening of the container.

The combination cap and closure sealing means are conjointly removable from the container as an integrated entity or unit, to expose or open the access opening by application of a pressure or lateral force proximate the upper end of the elongated cap structure, with a resultant angular tilting or tipping of the cap. This serves to disengage the combination closure cap structure and sealing means from the container, by a partial bending or loosening of the material which has been crimped under the container finish, for access to contents therein.

Other objects and advantages of the present invention will become readily apparent to those skilled in the art from the following detailed description, wherein there are shown and described preferred embodiments of the invention, simply by way of illustration of currently preferred and contemplated modes for carrying out the invention. As will be realized, the invention is capable of other and specific embodiments, and its several details are capable of modification in various, obvious respects, all without departing from the invention. Accordingly, the drawings and description are to be regarded merely as illustrative in nature, and not as restrictive.

BRIEF DESCRIPTION OF THE DRAWINGS

The accompanying drawings illustrate preferred embodiments of the invention and, when taken together with the description, serve to explain the principles and structure of the invention.

In the drawings.

DETAILED DESCRIPTION OF PREFERRED EMBODIMENTS

Figure 1:
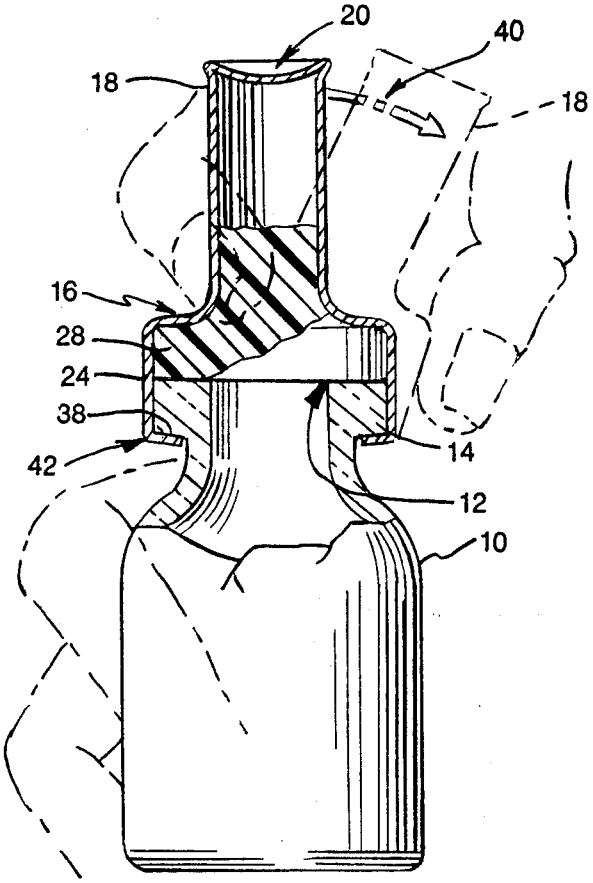
FIG. 1 is an elevational, partial pictorial view of an embodiment of the invention, and disclosing the closing and sealing position in full lines, whereas there is disclosed or shown a partially detached position of the cap in broken lines, parts of the drawing being broken away and in section, for disclosure of details.
Figure 2:
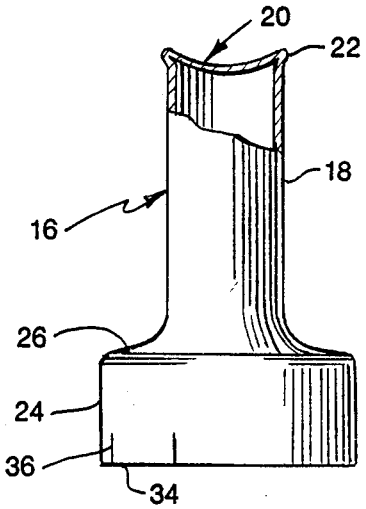
FIG. 2 is an elevational view of the cap, disclosing at a portion thereof, a scored skirt, and a portion of the top being broken away and disclosing a reinforcing and removal facilitating upsetting of the extreme top thereof.

The invention, and the principles thereof, are shown in the drawings and will be described with respect to use or in combination with a typical glass medicament containing serum vial. This container, or vial, is generally designated 10 in FIG. 1. The container, or vial, has a usual access opening indicated by arrow 12 at its open top or end. In the absence of means closing or sealing such opening, free access to the contents of the container is possible, regardless of the nature of the contents. Peripherally surrounding the access opening is a normal container finish 14, constituted in a known manner by a bead-like configuration.

The combination TIP-OFF cap and closure seal is generally indicated at 16. In the embodiment shown in the drawings, the cap portion is preferably formed by an all metal exterior construction such as aluminum, and, as shown, includes an upper, tubular, elongated portion 18. The upper end of the cap and portion 18 is upset as shown at 20, for purposes hereinafter to be described. The portion 18 might well be referred to as a flat portion permitting the removal of the cap as shown in dotted or broken lines in FIG. 1. The external ridge or rim 22 provides for better and more facile contact of a user's fingers during an opening procedure. Slippage is, accordingly, negligible. Integrally formed with the tubular upper portion, there is a lower, peripherally enlarged, hollow skirt portion 24 which constitutes the lower terminal portion of the cap. At the juncture between upper portion 18 and skirt 24 there is provided a peripherally extended sealing ridge 26. The cap portion is preferably of drawn aluminum metal, which can be readily dimensioned in thickness and configured as shown.

The closure seal of the invention is formed by a preferably resilient material, generally indicated, referring to FIG. 1, at 28. This material is placed within the interior of the cap portion by being poured or flowed therein, with the cap portion in an inverted position, thereby exposing the open terminal end of skirt portion 24. This sealing material can consist of various different materials, depending upon material to be contained in the container, some variations in functional operation and cost of the overall construction and formation of the finished cap. Contemplated, and useable in the invention, are plastisols, such as a vinyl chloride material which has been plasticized; liquid latex rubber; liquid silicone, which is a latex type of rubber, which is also a liquid elastomer. Various manufacturers, including Dow-Corning and General Electric, produce a suitable liquid silicone material. As long as the material is of a flowing type, it can be used, dependent upon container content, within the teachings of the invention. The material, in liquid form, is poured into the open end of the inverted cap and, depending upon the precise material used, will flow into and fill at least a portion of the interior of the cap and, in some instances, the entire interior thereof. Preferably, the liquid elastomer material is of an inexpensive type and, to this end, it appears that the plastisol is quite inexpensive as compared to rubber or liquid latex rubber and/or the liquid silicone material. Use of the plastisol also permits a natural bond to different metals, appropriately primed or treated, and will substantially reduce cost of the overall combined cap and seal unit. A substantial savings in cost can thereby be effected. Under normal circumstances, the plastisol material would not completely fill the interior of the cap but even if this occurred, the inexpensive nature of the material would render it less expensive than use of a rubber material. Therefore, even though volume-wise, a greater amount of material is used, there would be some cost trade-off between that and means to prevent complete filling of the cap. Additionally, silicone costs more than rubber and its use and introduction would be treated in a much similar manner to that of the rubber.

Figure 4:
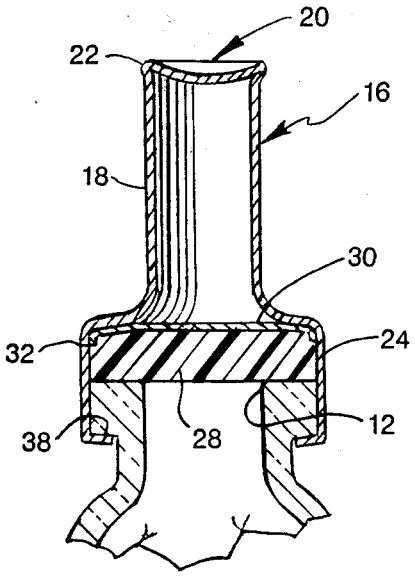
FIG. 4 is a fragmentary, elevational view of the combination cap and closure seal, including an additional interior disc means incorporated therein coacting with the seal and of significant usefullness in formation of the combination.
Figure 5:
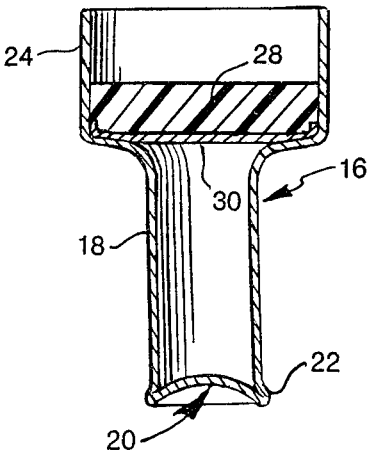
FIG. 5 is a sectional view of the embodiment disclosed in FIG. 4, but shown in an inverted position used during formation of the cap combination.

If, for example, it is desired to prevent a complete filling of the interior of the cap with the sealing material, then, as shown in FIGS. 4 and 5, for example, a metal or other suitable material disc 30, preferably having a turned or bent edge 32, is placed within the confines of the skirt portion 24 against the interior surface of the rim or edge 26. Then, when the seal material 28 is poured therein, it will be confined to that portion or area as shown in FIGS. 4 and 5, and will not flow into the elongated cap portion such as shown, for example, at least partially, in FIG. 1. Depending upon the material used, the consistency thereof, and other factors involved, a disc such as 30 can be selectively used. It is also to be understood that the material of the disc will depend somewhat upon the use of the seal material and the curing of the material. One type of plastisol, for example, must be heated to approximately 400° F. to appropriately solidify it. Silicone and rubber, while not requiring such heat, are substantially more expensive and it is therefore desired to prevent its flowing into the remainder of the cap, and therefore assume the configuration as shown in FIGS. 4 and 5. Being a resilient plastic material, all of the contemplated materials will serve to resiliently or elastically seal the access opening of the container. Variations in the materials and their proper usage within the teachings of the invention will be obvious to those skilled in the art.

As previously hereinbefore mentioned, the sealing material, having been placed within the cap and sufficiently set, the cap is now placed in sealing and closing relationship with the container, per se. This relationship is disclosed in FIGS. 1 and 4. After placement upon the top of the container, a downward pressure on the cap serves, through the medium of the rim or edge 26, to sealingly engage the sealing material 28 on and over the access 12 of the container.

Figure 3:
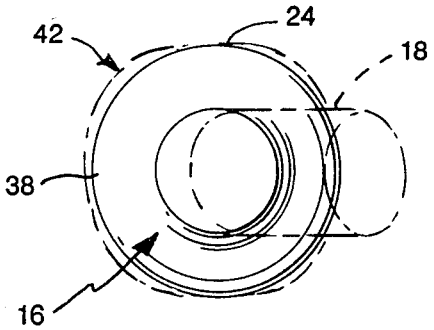
FIG. 3 is a top view of the cap of the invention, disclosing in broken lines, the condition of the cap when being removed from a container.

In order to insure this sealing engagement and affixation to the container during shipment, storage and/or normal usage, the crimping of the lower terminal edge 34 of skirt 24 is accomplished in a known and usual manner. To facilitate the crimping and also to facilitate removal of the cap and sealing material therein from the container, the lower end of skirt 24 is provided with a plurality of peripherally spaced scores or score lines at 36. This results in weakened areas of the skirt portion and facilitates a bending around and under the lower surface 38 of finish 14. These score lines 36 serve a further function in the removal of the cap and closure seal combination from the container. As the container is gripped in one hand by a user and the fingers placed in the position shown in FIG. 1, with a lateral force being applied against the upper portion of the extended cap portion as indicated by arrow 40, the material of the cap will tend to sever or, at least, more easily bend in proximity to or at the score lines. This results in an action as shown in FIG. 3. In FIG. 3, the pressure referred to in the direction of arrow 40 has been applied against the cap. The lower terminal edge 34 in the region 42 will tend to stretch or break and thereby permit removal of the cap and the sealing material therein as shown in broken lines in FIG. 1. It is to be noted that the thickness and construction of the cap and material will play a significant part in this overall end result. Such variations as might be required or desired are well within the scope of those skilled in the art and need not be further delineated herein.

During the removal process, the normal peripheral outline of the inturned edge of the lower surface 38 as shown in full lines in FIG. 3 will tend to flatten out as indicated by the broken line showing at 42. In other words, the material constituting the cap will be distorted and, in so doing, the inturned or crimped edge will ride outwardly, upwardly and free over the upper end of the container to efficiently and effectively remove the sealing material from over the access opening of the container.

The function of the structure shown in FIGS. 1 and 4 will be substantially identical, especially in view of the fact that the disc is sealed or connected to the remainder of the cap by contact between the sealing material below the disc and the interior of the skirt. Under some circumstances, the disc 30 can be provided with an opening or perforation therethrough, with a resultant material saving and/or enhanced affixation between the sealing material and that of the disc.

Under some circumstances, it might be possible to remove the scoring lines dependent upon the material and configuration utilized, but in any event, care must be taken to insure that, in the absence of score lines, any attempted tampering or pilfering efforts would result in an external visual indication. This is of the essence of the invention.

It is accordingly seen that the present invention provides a combination TIP-OFF cap and closure container seal operatively connected to an open ended container for closure thereof, and sealing of the contents therein. The cap includes a narrow, elongated top portion, a peripherally enlarged open ended bottom skirt at the base of the top portion, container access opening closure seal means operatively disposed within the skirt, and operatively integrated therewith. The combination, integrated cap and closure seal, are removable conjointly from the container as a unit or entity, for access to liquids therein by application of a lateral pressure or tilting force against the exterior of the narrow, elongated cap at a position thereof remote from connection of the cap to the container. Removal of the integrated cap and closure seal from the container is normally effected in a manner generally similar to currently used types of glass ampules, but substantially eliminating container breakage, to thereby diminish personnel injury or container content contamination. Obviously, other types of containers can use the combined cap in a manner similar to that hereinabove described. In this disclosure, there are shown and described only preferred emboidments of the invention, but as aforementioned, it is to be understood that the invention is capable of changes and/or modifications within the scope of the inventive concept as expressed herein.

I claim:

1. A combination cap and container closure and sealing means, adapted for operative connection to a container having an access opening, to seal the contents therein, said cap comprising an elongated, exterior top portion, and a bottom, open-ended skirt operatively integrated therewith, said skirt having a lower edge removably attachable to said container about said access opening, said combination cap and closure sealing means being conjointly operatively connectable to and removable from said container as an integrated unit to open the container for access to material therein, by application of a lateral tilting force against the elongated cap exterior portion at a position thereof remote from connection of the cap to the container, said sealing means comprising a resilient material integrated with the cap interior and disposed within the interior of at least said skirt portion and extending into a portion of said elongated exterior top portion of said cap and being sealingly engaged with and about said access opening with said cap operatively mounted on said container.

2. A combination cap and container closure and sealing means as claimed in claim 1, said resilient material comprising a partially hardenable elastomeric material, the material being insertable within the interior of said cap by flowing the material therein and thereafter causing a partial hardening thereof while retaining the resilient nature of the material.

3. A combination cap and container closure and sealing means as claimed in claim 2, wherein said elastomeric material is selected from the group consisting of plastisol, latex, liquified rubber and liquid silicone, the material being flowed into the interior of the cap and thereafter being solidified therein while retaining the inherent resiliency of the material, the solidification occurring through appropriate curing of the specific material utilized.

4. A combination cap and container closure and sealing means as claimed in claim 1, said exterior top portion being substantially narrowed with respect to said bottom, open-ended skirt portion and providing a portion against which an operator's fingers can press during an opening operation by application of said lateral tilting force.

5. A combination cap and container closure and sealing means as claimed in claim 4, the juncture between said elongated, narrow exterior top portion and said bottom open-ended skirt being constituted by a peripheral outwardly extending flange area, said flange area serving, during sealing placement of said combination cap on a said container, to sealingly press said sealing material against and over said access opening and being maintained in sealing engagement by said lower edge as attached to said container.

6. A combined cap and container opening closure and sealing means as claimed in claim 1, said exterior cap portion consisting of metal.

7. A combination cap and container opening closure and sealing means as claimed in claim 1, the upper end of said elongated exterior top portion being dished to strengthen said portion and, additionally, forming an outwardly extended peripheral ridge to facilitate engagement by a user's fingers for application of a lateral tilting cap removing force thereagainst.

8. A combination cap and container opening closure and sealing means as claimed in claim 7, said metal material consisting of aluminum, said sealing means comprised of resilient material consisting of a material adhereable to the metal of said cap for integration therewith.

9. A combination cap and container closure and sealing means as claimed in claim 1, said container having a finish around said access opening, the lower edge of said skirt being crimped around said finish to removably fasten said composite cap to said container, said lateral tilting force serving to uncurl, at least partially, the crimped edge for release of said cap from said container.

10. A combination cap and container closure and sealing means as claimed in claim 9, the lower edge of said skirt having a plurality of peripherally spaced scores therein for lowering a required said lateral tilting force to separate said cap from said container.

* * * * *